US006044510A

United States Patent [19]

Cho

[11] Patent Number: 6,044,510

[45] Date of Patent: Apr. 4, 2000

[54] METHOD FOR CONTROLLING THE WASHING OPERATION OF A WASHING MACHINE

[75] Inventor: Sung-won Cho, Yongin, Rep. of Korea

[73] Assignee: Samsung Electronics Co., Ltd., Suwon, Rep. of Korea

[21] Appl. No.: 09/158,506

[22] Filed: Sep. 23, 1998

[30] Foreign Application Priority Data

May 13, 1998 [KR] Rep. of Korea ..... 17114-98

[51] Int. Cl.[7] ..... D06F 33/02

[52] U.S. Cl. ..... 8/158; 8/159; 68/12.03; 68/12.05; 68/12.21

[58] Field of Search ..... 8/158, 159; 68/12.03, 68/12.05, 12.21

[56] References Cited

U.S. PATENT DOCUMENTS

| | | | |
|---|---|---|---|
| 3,194,250 | 7/1965 | DeLapena . | |
| 5,133,200 | 7/1992 | Tanaka et al. | 68/12.03 |
| 5,299,340 | 4/1994 | Moon | 8/158 |
| 5,560,060 | 10/1996 | Dausch et al. | 68/12.03 X |

FOREIGN PATENT DOCUMENTS

| | | |
|---|---|---|
| 1 171 432 | 1/1959 | France . |
| 2 384 055 | 10/1978 | France . |
| 2-2313 | 1/1990 | Japan . |
| 4-105696 | 4/1992 | Japan . |
| 4-122294 | 4/1992 | Japan . |
| 4-256789 | 9/1992 | Japan . |
| 6-54982 | 3/1994 | Japan . |
| 2 043 954 | 10/1980 | United Kingdom . |

*Primary Examiner*—Philip R. Coe

*Attorney, Agent, or Firm*—Burns, Doane, Swecker & Mathis, L.L.P.

[57] ABSTRACT

Disclosed is a method for controlling a heating-washing operation of a washing machine. A microprocessor has many subroutines for providing optimal washing conditions of the washing machine in correspondence to respective temperatures of washing water, through which optimal washing effect is achieved. Washing water is heated until the temperature thereof reaches a set temperature, and the temperature of washing water is measured while heated. The microprocessor performs individual subroutines corresponding to the measured temperature. The subroutines have data about the amount of washing water, rotational velocity of a drum, and a period for changing the rotational direction of the drum. Heating is stopped when the temperature of washing water reaches the set temperature, and the microprocessor performs the washing operation according to the subroutine corresponding to the set temperature. Thus, washing effect is maximized and energy is saved.

5 Claims, 4 Drawing Sheets

METHOD FOR CONTROLLING THE WASHING OPERATION OF A WASHING MACHINE

BACKGROUND OF THE INVENTION

1. Field of the Invention

The present invention relates to a method for controlling the washing operation of a washing machine, and more particularly, to a method for controlling the washing operation of a washing machine capable of changing washing conditions according to the change in temperature of washing water, so that the optimal washing effect is achieved.

2. Prior Art

FIG. 1 shows a conventional washing machine, which shows a drum type washing machine. The drum type washing machine has a body 1, a tub 2 supported in the body 1 by a suspension and a shock absorber which are not shown, and a drum 3 installed in the tub 2 to be capable of rotating. A plurality of dehydration ports 3*a* and protrusions 3*b* are formed on the inner side of the drum 3.

A driving device 5 for driving the drum 3 is installed one side of the tub 2, and a draining device 7 for draining washing water in the drum 3 after the washing operation has completed is provided under the tub 2. A heating device 9 for heating the washing water in the drum 3 is installed at the upper side of the tub 2, and a door 8 for opening/closing the tub 2 is installed on the front side of the body 1.

Meanwhile, a water supply device 6 for supplying the drum 3 with water used for washing is installed in the upper area of the body 1. A detergent supplier 4 having a detergent container 4*a* is installed in front of the water supply device 6. On the upper front area of the body 1, a control panel 10 is provided, through which a user controls the operational status of the washing machine.

The operations of the washing machine consists of a washing operation, a rinsing operation, and a dehydrating operation. In order to perform the washing operation, the user opens the door 8 and puts laundry into the drum 3, and then utilizes the control panel 10. A microprocessor (not shown) in the washing machine controls the operation of the washing machine according to the input to the control panel 10 given by the user.

In more detail, the water supply device 6 and the detergent supplier 4 supply washing water and detergent into the drum 3. As the drum 3 is rotated by the driving device 5, the washing operation is performed. That is, as the drum 3 is rotated, the laundry in the drum 3 is raised by the drum 3 and then is dropped. The washing operation of the detergent is performed by the impact applied to the laundry in such a situation. The drum 3 is rotated in forward and reverse directions alternately. Meanwhile, in order to perform the washing operation with hot water, the heating device 9 operates while the drum 3 is rotated.

FIG. 2 shows the process for performing the heating-washing operation of the conventional washing machine. When a user sets S101 a time and a temperature through the control panel 10, the washing machine performs heating operation S102 during the washing operation.

A sensor (not shown) in the washing machine measures S103 the temperature of the washing water. The microprocessor judges S104 whether the measured temperature is higher than the set temperature or not. If the measured temperature is lower than the set temperature, the washing and heating operations are performed continuously, and if the measured temperature is higher than the set temperature, the washing and heating operations are stopped S105.

The washing operation continues while the heating operation is stopped, and the microprocessor measures S106 the time that the washing operation is performed. If the measured time reaches S107 the set time, the washing operation ends.

After the heating-washing operation has been completed, the washing water is drained from the tub 2 by the draining device 7, and thereafter, the rinsing operation consisting of supply of water, rinsing, and draining is performed. After the rinsing operation has been completed, the washing water is drained again by the draining device 7, and then the dehydrating operation is performed. The drum 3 is rotated at a high velocity during the dehydrating operation, and the laundry is dehydrated by the centrifugal force generated by rotating drum 3.

However, in such a conventional method for controlling the heating-washing operation, a simple washing operation is continuously performed while the washing water is heated, irrespective of the variation of the temperature, so there is a shortcoming that the washing effect is not maximized. In order to improve the washing effect, it is preferable that the washing machine is driven according to an optimal operational condition corresponding to the temperature of the washing water.

Furthermore, in the conventional method for controlling the heating-washing operation, the heating operation is performed after the entire amount of washing water set by the user has been supplied, so the time consumed until the washing water reaches the set temperature is long, and thereby washing efficiency is lowered. Moreover, in such a situation, the washing operation is performed while the washing water is at a low temperature before it reaches the set temperature, so the washing operation is performed with the washing effect being insufficient, which may also result in low energy efficiency.

SUMMARY OF THE INVENTION

The present invention has been proposed to overcome the above described problems in the prior art, and accordingly it is an object of the present invention to provide a method for controlling a washing operation of a washing machine capable of changing washing conditions according to the change in temperature of washing water, so that an optimal washing effect and high energy efficiency can be achieved.

To achieve the above object, the present invention provides a method for controlling an washing operation of a washing machine comprising the steps of: preparing a plurality of subroutines for providing optimal washing conditions for the washing machine in correspondence to respective temperatures of washing water, the washing conditions through which an optimal washing effect is achieved; heating the washing water in a drum until the temperature of the washing water reaches a set temperature; measuring the temperature of the washing water during the heating step; performing one of the subroutines corresponding to the temperature measured in the measuring step; and stopping the heating operation when the measured temperature reaches the set temperature.

Here, the washing conditions may comprise data about an optimal amount of washing water, a duration time of respective temperatures measured in the measuring step, a rotational velocity of the drum, and a period for changing a rotational direction of the drum.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
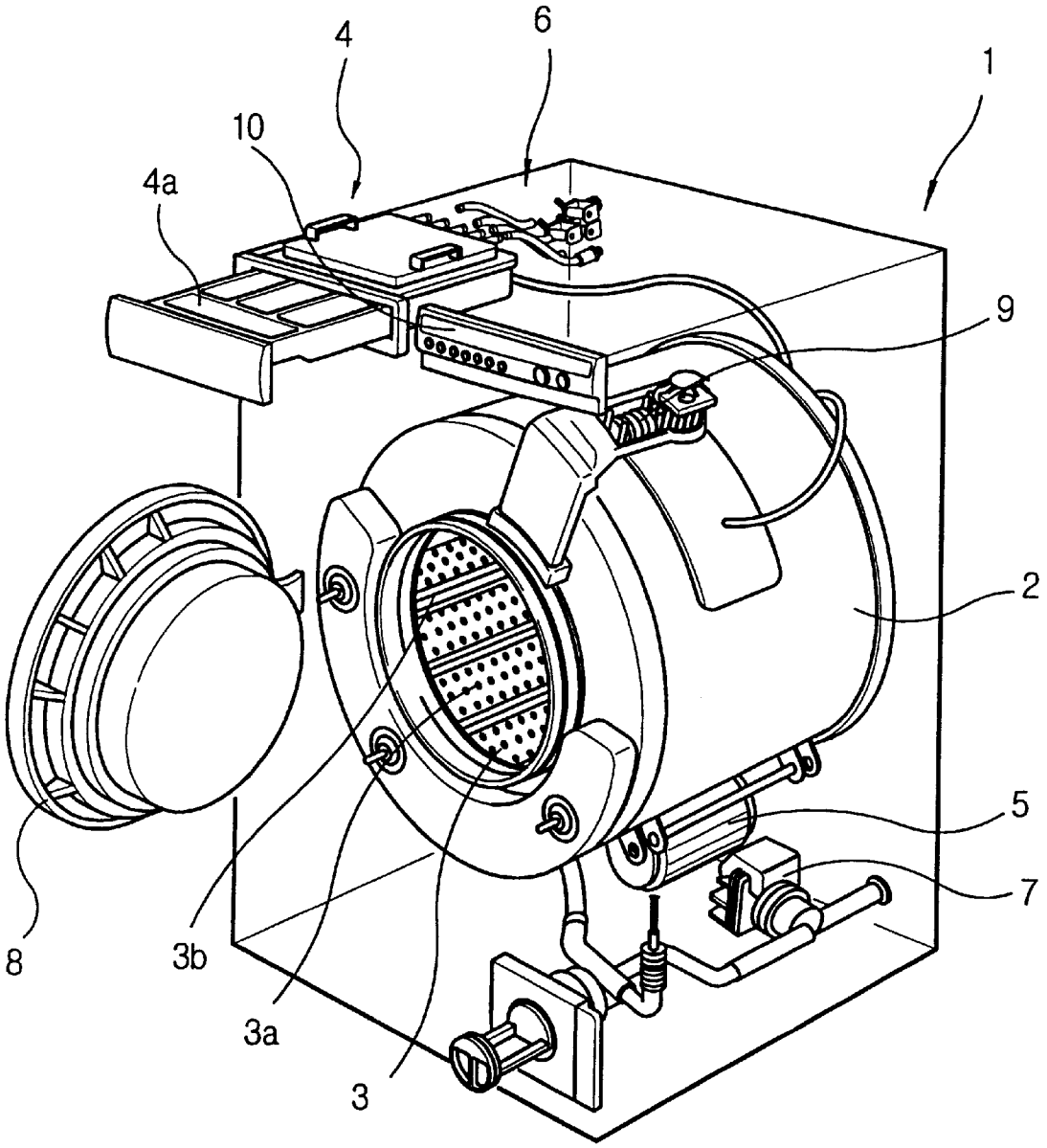
FIG. 1 (PRIOR ART)
FIG. 1 is a perspective view of a conventional drum type washing machine.

Hereinafter, the present invention will be described in detail with reference to the drawings. Parts identical to those in the conventional washing machine shown in FIG. 1 will not be described, and will be referred to with the same reference numerals.

Figure 3:
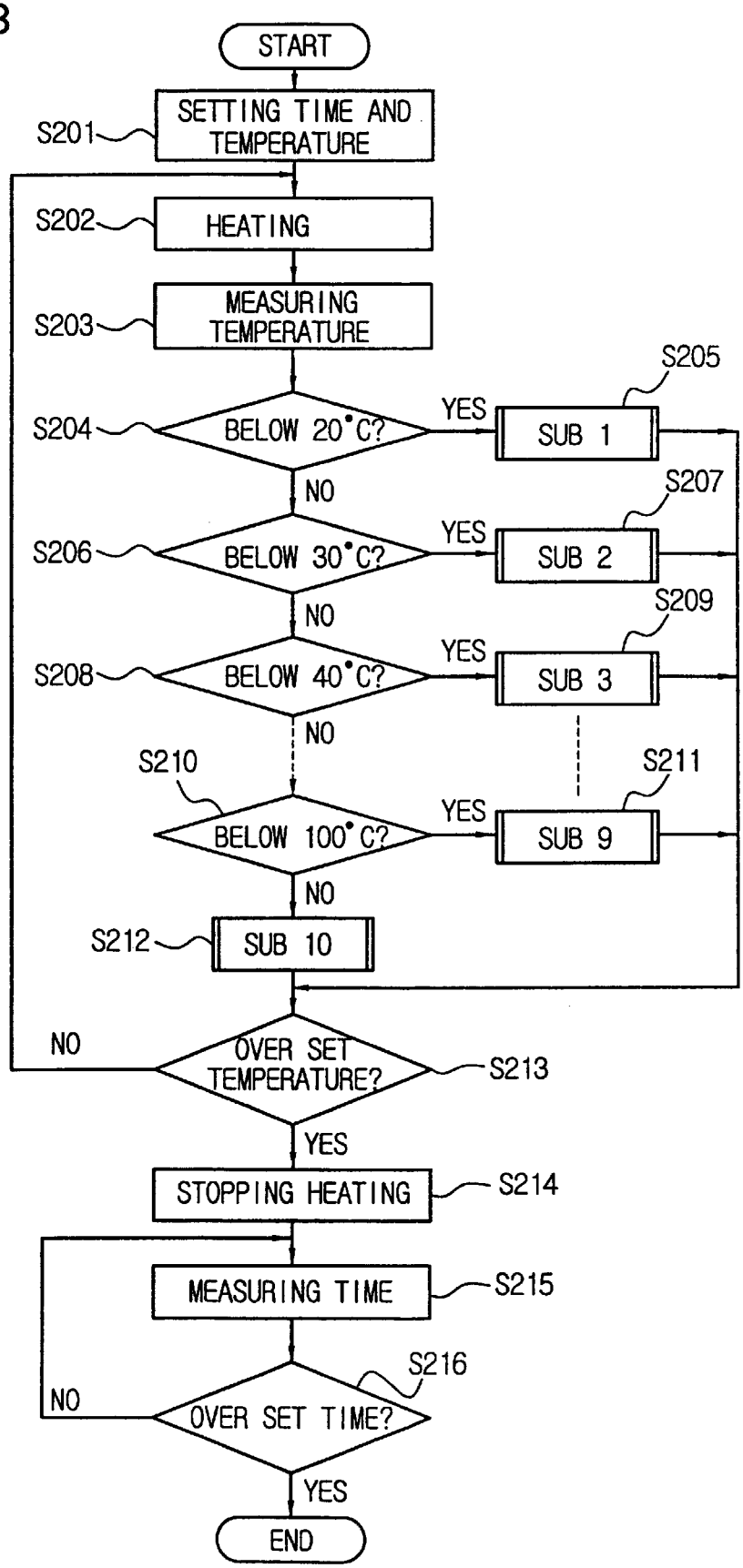
FIG. 3 is a flow chart showing the method for controlling the heating-washing operation according to the present invention.

FIG. 3 is a flow chart showing the method for controlling the heating-washing operation according to the present invention. A plurality of subroutines are pre-input into the microprocessor in the washing machine. The subroutines correspond to a variety of temperatures of the washing water, respectively. Respective subroutines provide optimal washing conditions in correspondence to temperatures of the washing water, the washing conditions through which an optimal washing effect can be achieved as will be described later.

When the user sets S201 a time and a temperature through the control panel 10, the washing machine performs the heating operation S202.

The sensor (not shown) in the washing machine measures S203 the temperature of the washing water. If the measured temperature is below 20 degrees centigrade S204, the microprocessor controls the operation of the washing machine, such as the amount of the washing water supplied into the drum 3 or the rotational velocity of the drum 3, so that the washing operation is performed according to the first subroutine S205.

If the measured temperature is below 30 degrees centigrade S206, the microprocessor controls the operation of the washing machine so that the washing operation is performed according to the second subroutine S207, and if the measured temperature is below 40 degrees centigrade S208, the microprocessor controls the operation of the washing machine so that the washing operation is performed according to the third subroutine S209.

As above, the temperature of the washing machine is checked at 10 degree centigrade intervals, whereby if the measured temperature is below 100 degrees centigrade S210, the ninth subroutine is performed S211, and if the measured temperature is over 100 degrees centigrade, the tenth subroutine is performed S212.

The microprocessor checks S213 whether the washing water reaches the set temperature while a subroutine is performed. If the measured temperature is below the set temperature, the washing and heating operations are continued, and if the measured temperature is over the set temperature, the heating operation is stopped S214. While the heating operation is stopped, the washing operation is performed according to the subroutine corresponding to the set temperature. The microprocessor measures S215 the time that the washing operation is performed, and if it reaches the set time S216, the washing operation ends.

Figure 2:
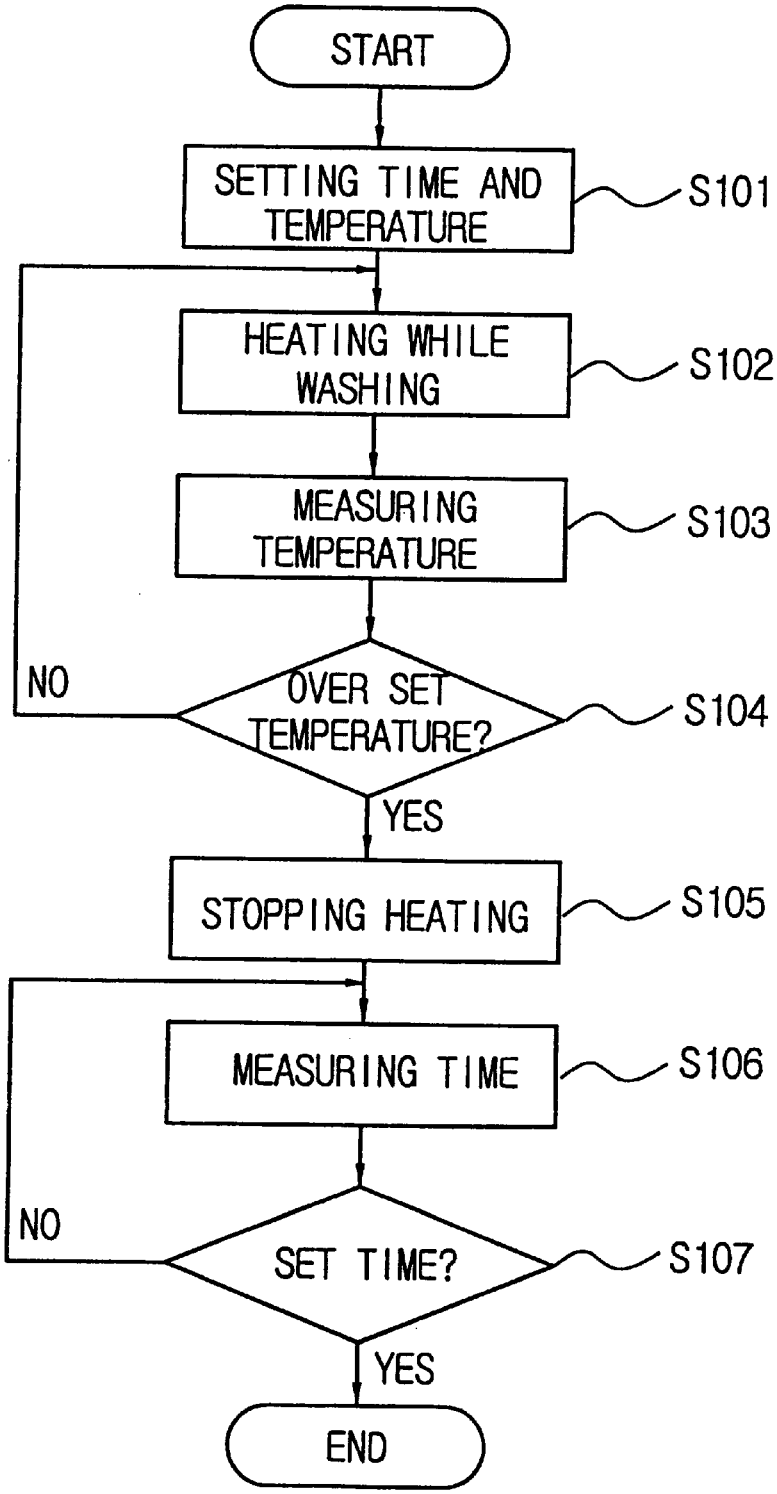
FIG. 2 (PRIOR ART)
FIG. 2 is a flow chart showing the conventional method for controlling the heating-washing operation

After the above-described heating-washing operation ends, the rinsing operation and the dehydrating operation are performed consecutively, which are the same with those having been described in the description of the prior art shown in FIGS. 1 and 2.

Figure 4:
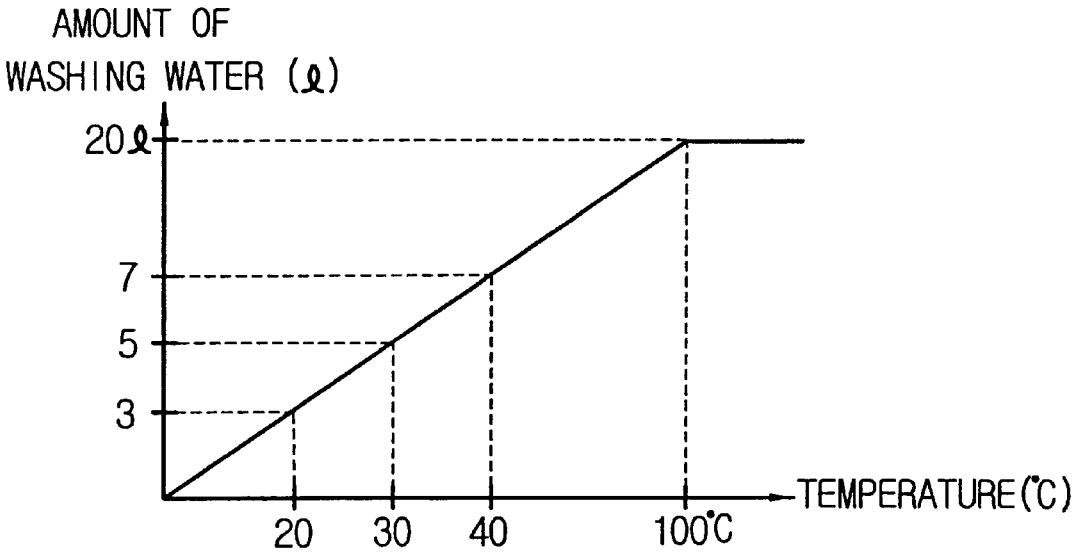
FIG. 4 is a graph for showing an optimal amount of washing water through which an optimal washing effect is achieved according to the variation in temperature of washing water.

An example of the washing conditions set in each of the subroutines is shown in FIG. 4. FIG. 4 shows an optimal amount of washing water through which an optimal washing effect is achieved according to the variation of the temperature of washing water. For example, if the temperature of the washing water is 20 degrees centigrade, it is preferable that the drum 3 is supplied with three liters of washing water. Thus, in the first subroutine corresponding to 20 degrees centigrade, the amount of the washing water is set to three liters. The microprocessor controls the water supply device 6 so that the drum 3 is supplied with three liters of washing water if the first subroutine is performed.

If the temperature of the washing water is 40 degrees centigrade, it is preferable that the drum 3 is supplied with seven liters of washing water. Thus, the amount of the washing water is set to seven liters in the third subroutine. The microprocessor controls the water supply device 6 so that the drum 3 is supplied with seven liters of washing water if the third subroutine is performed. Similarly, in each of the subroutines, the optimal amount of washing water is set on the basis of the graph shown in FIG. 4.

The optimal amount of the washing water through which the optimal washing effect is achieved is not determined according to FIG. 4 in all types of washing machines, but determined to be different for every kind of washing machine. Such data are achieved experimentally in consideration of the kind of the washing machine, washing capacity of detergent, energy consumption, or washing effect produced by the drop of the laundry during the rotation of the drum 3.

As described above, the washing effect and the energy efficiency can be enhanced by increasing the amount of the washing water little by little in proportional to the temperature of the washing water. Furthermore, since a small amount of the washing water is supplied while the temperature is low, the temperature of the washing water can reach the temperature set by the user in a short period of time.

FIG. 4 shows only the condition concerning the amount of the washing water among the washing conditions set in the respective subroutines, however, such washing conditions can comprise many types of data. That is, washing conditions may comprise data about a preferable duration time that the washing water is maintained to respective temperatures, the number of rotations of the drum 3, and a period for changing the rotational direction of the drum 3. Such data are also determined experimentally in consideration of the aforementioned factors.

For example, while the temperature of the washing water is low and the amount of the washing water is small, it is preferable that the rotational velocity of the drum 3 is small and the period for changing the rotational direction is great. Then, energy is saved while the washing, effect is not great. Further, as the temperature of the washing water approaches the set temperature and the amount of the washing water increases, it is preferable that the rotational velocity of the drum 3 increases and the period for changing the rotational direction is shortened, whereby the washing effect increases. Accordingly, the overall energy efficiency is improved and the washing effect is maximized.

Furthermore, since the total operation time of the washing machine is confined to the time set by the user, it is preferable that the time the temperature of the washing water is closer to the set temperature is longer than the duration of time the temperature of the washing water is lower than the set temperature.

As described above, each of the subroutines has a variety of washing conditions corresponding to respective temperatures of the washing water, the washing conditions through which optimal washing effect is achieved and the energy efficiency is improved, and the microprocessor can improve the washing effect by performing the subroutines corresponding to the respective temperatures while the temperature of the washing water changes. Therefore, according to the present invention, washing effect is maximized and the energy is saved.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A method for controlling a washing operation of a washing machine having a clothes washing drum, said method comprising the steps of:

establishing a plurality of subroutines for providing optimal washing conditions for said washing machine in correspondence to respective temperatures of washing water, said optimal washing conditions achieving an optimal washing effect;

heating the washing water in said clothes washing drum until the temperature of the washing water reaches a set temperature;

measuring the temperature of the washing water during the heating step;

performing one of said subroutines corresponding to the temperature measured in the measuring step; and stopping the heating operation when the measured temperature reaches the set temperature.

2. The method for controlling the washing operation as claimed in claim 1, wherein said washing conditions comprise data about an optimal amount of washing water corresponding to the temperature of the washing water.

3. The method for controlling the washing operation as claimed in claim 1, wherein said washing conditions comprise data about a duration time of respective temperatures measured in the measuring step.

4. The method for controlling the washing operation as claimed in claim 1, wherein said washing conditions comprise data about a rotational velocity of said drum.

5. The method for controlling the washing operation as claimed in claim 1, wherein said washing conditions comprise data about a period for changing a rotational direction of said drum.

* * * * *